US009376252B2

(12) United States Patent
Yoshikawa

(10) Patent No.: US 9,376,252 B2
(45) Date of Patent: Jun. 28, 2016

(54) BOOT HOUSING DEVICE

(71) Applicant: Kabushiki Kaisha Yoshikawakuni Kogyosho, Nara-ken (JP)

(72) Inventor: Toshiyuki Yoshikawa, Nara-ken (JP)

(73) Assignee: Kabushiki Kaisha Yoshikawakuni Kogyosho, Nara-ken (JP)

( * ) Notice: Subject to any disclaimer, the term of this patent is extended or adjusted under 35 U.S.C. 154(b) by 0 days.

(21) Appl. No.: 14/547,398

(22) Filed: Nov. 19, 2014

(65) Prior Publication Data

US 2015/0259133 A1 Sep. 17, 2015

(30) Foreign Application Priority Data

Mar. 12, 2014 (JP) ..... 2014-049297

(51) Int. Cl.

| | |
|---|---|
| ***A47F 7/08*** | (2006.01) |
| ***A47F 5/00*** | (2006.01) |
| ***B65D 85/18*** | (2006.01) |
| ***B65D 25/10*** | (2006.01) |
| ***A47B 61/04*** | (2006.01) |

(Continued)

(52) U.S. Cl.

CPC ..... *B65D 85/187* (2013.01); *A45C 3/12* (2013.01); *A47B 61/04* (2013.01); *A47F 7/08* (2013.01); *A47L 23/20* (2013.01); *B65D 25/10* (2013.01)

(58) Field of Classification Search

CPC ..... A47G 25/00; B65D 85/187; B65D 25/10; B65D 85/18; A47F 7/08; A47F 7/10; A47F 5/10; A47F 5/12; A47B 61/02; A47B 61/04; A47B 45/00; A47B 96/025; A47L 23/20; E05B 69/003; B66F 5/04; B66F 5/02; A45C 3/12

USPC ..... 211/1.3, 34, 37, 38, 175, 207, 208; 12/123, 114.8, 53.7, 53.6, 123.3, 12/123.5; 223/113–117; 15/265–268; 248/161, 157, 407, 410, 411; 254/2 B, 254/98, 93 R, 7 R

See application file for complete search history.

(56) References Cited

U.S. PATENT DOCUMENTS

| | | | | | |
|---|---|---|---|---|---|
| 389,445 | A * | 9/1888 | Crede | ..... | A47B 39/00 248/411 |
| 390,381 | A * | 10/1888 | Luetke | ..... | A47B 39/00 248/411 |
| 398,408 | A * | 2/1889 | Koehn | ..... | A47B 39/00 248/411 |

(Continued)

FOREIGN PATENT DOCUMENTS

| | | |
|---|---|---|
| JP | H01-105567 U | 7/1989 |
| JP | 08-308603 A | 11/1996 |

(Continued)

OTHER PUBLICATIONS

Japanese Office Action dated Jan. 29, 2016 issued in connection with related Japanese Patent Appl. No. 2014-049297.

*Primary Examiner* — Jennifer E Novosad

(74) *Attorney, Agent, or Firm* — Berliner Steffin Azod LLP

(57) ABSTRACT

A boot housing device includes: a body having an upper end and a lower end, the body including two leg parts arranged with a specific gap therebetween on its lower end side so as to allow a toe of a boot to be arranged in the gap; and an elevating member including a support pole supported by the body and a shoe receiving part that is attached to an upper end of the support pole and is arranged above the body, the elevating member being provided movably in an axial direction of the support pole.

6 Claims, 5 Drawing Sheets

(51) Int. Cl.
*A47L 23/20* (2006.01)
*A45C 3/12* (2006.01)

(56) References Cited

U.S. PATENT DOCUMENTS 446,312 A * 2/1891 Wikle ..... A43D 5/02 12/123
541,806 A * 6/1895 Bobrick ..... A47B 39/00 248/411
686,314 A * 11/1901 Mansfield ..... F26B 21/006 12/123
862,943 A * 8/1907 Swart ..... A47B 27/02 108/4
1,286,878 A * 12/1918 Granger ..... A47B 39/00 184/38.1
1,736,121 A * 11/1929 Konikoff ..... A47F 7/08 211/37
1,862,168 A * 6/1932 Weiskotten ..... A43D 3/1416 12/114.8
2,051,833 A * 8/1936 Ehrlich ..... A45D 20/22 248/371
2,070,858 A * 2/1937 Des Jardins ..... A43D 3/1491 12/103
2,184,458 A * 12/1939 La Chapelle ..... A43D 3/022 12/123
2,309,546 A * 1/1943 Shapiro ..... A61L 2/06 15/257.1
2,566,656 A * 9/1951 David ..... A47L 23/18 12/120.5
3,078,526 A * 2/1963 Caruso ..... A61L 2/202 194/242
3,292,794 A * 12/1966 Lowe ..... A47F 7/08 12/53.7
3,412,866 A * 11/1968 Binding ..... A43B 5/0425 12/120.5
3,417,482 A * 12/1968 Peet ..... A47L 23/20 219/523
3,534,426 A * 10/1970 Adkisson, Jr. ..... A43D 3/1416 12/123
3,747,774 A * 7/1973 Kulik ..... A47F 7/08 211/37
4,149,290 A * 4/1979 Sansen ..... A47G 25/005 12/114.8
5,556,064 A * 9/1996 Cowe ..... F16M 11/00 211/175
5,676,259 A * 10/1997 Charchaflian ..... A47F 1/12 211/162
5,876,011 A * 3/1999 Blasing ..... F16M 11/28 248/170
5,882,076 A * 3/1999 Garelick ..... A47C 15/004 248/411
6,012,592 A * 1/2000 Ferguson ..... B60R 11/00 211/34
6,027,086 A * 2/2000 Heitlinger ..... A47B 91/024 248/188.5
6,308,838 B1 * 10/2001 Endean ..... A47F 7/08 211/205
8,360,252 B1 * 1/2013 Fagan ..... B62H 3/00 211/21
8,925,741 B2 * 1/2015 Chiang ..... A47G 25/005 211/118
2004/0144593 A1 * 7/2004 Shai ..... E04G 1/22 182/141
2007/0221590 A1 9/2007 Dhaveloose
2007/0251895 A1 * 11/2007 Griffin ..... A47F 7/08 211/37
2009/0008345 A1 * 1/2009 Sabounjian ..... A47F 7/08 211/35
2009/0230069 A1 * 9/2009 Naden ..... A47B 49/004 211/144
2010/0066222 A1 * 3/2010 Ito ..... A47B 61/04 312/326
2011/0126420 A1 * 6/2011 Blais ..... A47L 23/20 34/239
2012/0176013 A1 * 7/2012 Woods ..... A47B 61/00 312/270.3
2013/0206797 A1 * 8/2013 Ivoska ..... A47B 61/04 223/84
2014/0097148 A1 * 4/2014 Cheng ..... A47B 61/04 211/34
2015/0113827 A1 * 4/2015 Goulet ..... F26B 9/06 34/443
2015/0259133 A1 * 9/2015 Yoshikawa ..... B65D 25/10 206/216

FOREIGN PATENT DOCUMENTS

JP H09-010089 A 1/1997
JP H11-113714 A 4/1999
JP 2005-065831 A 3/2005
JP U3132802 6/2007
JP 2007-275224 A 10/2007
JP 2008-253462 A 10/2008
JP 3146802 U 12/2008

* cited by examiner

BOOT HOUSING DEVICE

CROSS-REFERENCE TO RELATED APPLICATION

This application claims the benefit of Japanese Patent Application No.

2014-049297, filed on Mar. 12, 2014, which is incorporated herein by reference.

BACKGROUND OF THE INVENTION

1. Field of the Invention

The present invention relates to a boot housing device for housing boots.

2. Background Art

Boots each include a boot shaft extending vertically. Therefore, boots occupy a large space during storage. Accordingly, a boot housing device is provided in order to save the storage space for boots (see, for example, Japanese Utility Model Registration No. 3132802).

Such a boot housing device of this type includes: a body having an upper end and a lower end, the body including two leg parts arranged with a specific gap therebetween on its lower end side so as to allow a toe of a boot to be arranged in the gap; and a shoe receiving part coupled to the upper end of the body. According to the boot housing device of this type, the shoe receiving part having a length corresponding to the length of the boot shaft is coupled to the upper end of the body. When boots are housed, the shoe receiving part is inserted into a boot shaft of a boot for one foot. Thus, the boot is supported by the shoe receiving part. A boot for the other foot is housed in the boot housing device with its toe being arranged between the two leg parts. In this way, a pair of boots are placed vertically, and therefore the boot housing device of this type can save the space as compared to the case of housing the boots in horizontal alignment.

SUMMARY OF THE INVENTION

Meanwhile, the length of a boot shaft differs from boot to boot in view of design properties, etc. Therefore, in the case of housing boots having boot shafts with a different length using the boot housing device of this type, a shoe receiving part with a different length needs to be attached to the body, corresponding to the length of the boot shaft. Accordingly, a space for storing a plurality of shoe receiving parts with different lengths has been needed.

In view of the circumstances, it is an object of the present invention to provide a boot housing device without the need to store a plurality of parts.

The following presents a simplified summary of the invention disclosed herein in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

A boot housing device according to the present invention includes: a body having an upper end and a lower end, the body including two leg parts arranged with a specific gap therebetween on its lower end side so as to allow a toe of a boot to be arranged in the gap; and an elevating member including a support pole supported by the body and a shoe receiving part attached to an upper end of the support pole and arranged above the body, the elevating member being provided movably in an axial direction of the support pole.

Further, the boot housing device according to the present invention may further include a positioning mechanism configured to regulate elevation of the elevating member relative to the body.

According to another aspect, the boot housing device according to the present invention may have a configuration in which the positioning mechanism includes an engaging part that is provided in the support pole and is arranged along the axial direction of the support pole, and an engaging claw that is provided in the body and is movable in a direction intersecting the axial direction of the support pole.

According to another aspect, the boot housing device according to the present invention may have a configuration in which the shoe receiving part includes a housing part capable of housing a drug.

BRIEF DESCRIPTION OF THE DRAWINGS

The foregoing and other features of the present invention will become apparent from the following description and drawings of an illustrative embodiment of the invention in which.

DETAILED DESCRIPTION OF THE PREFERRED EMBODIMENT

Figure 1:
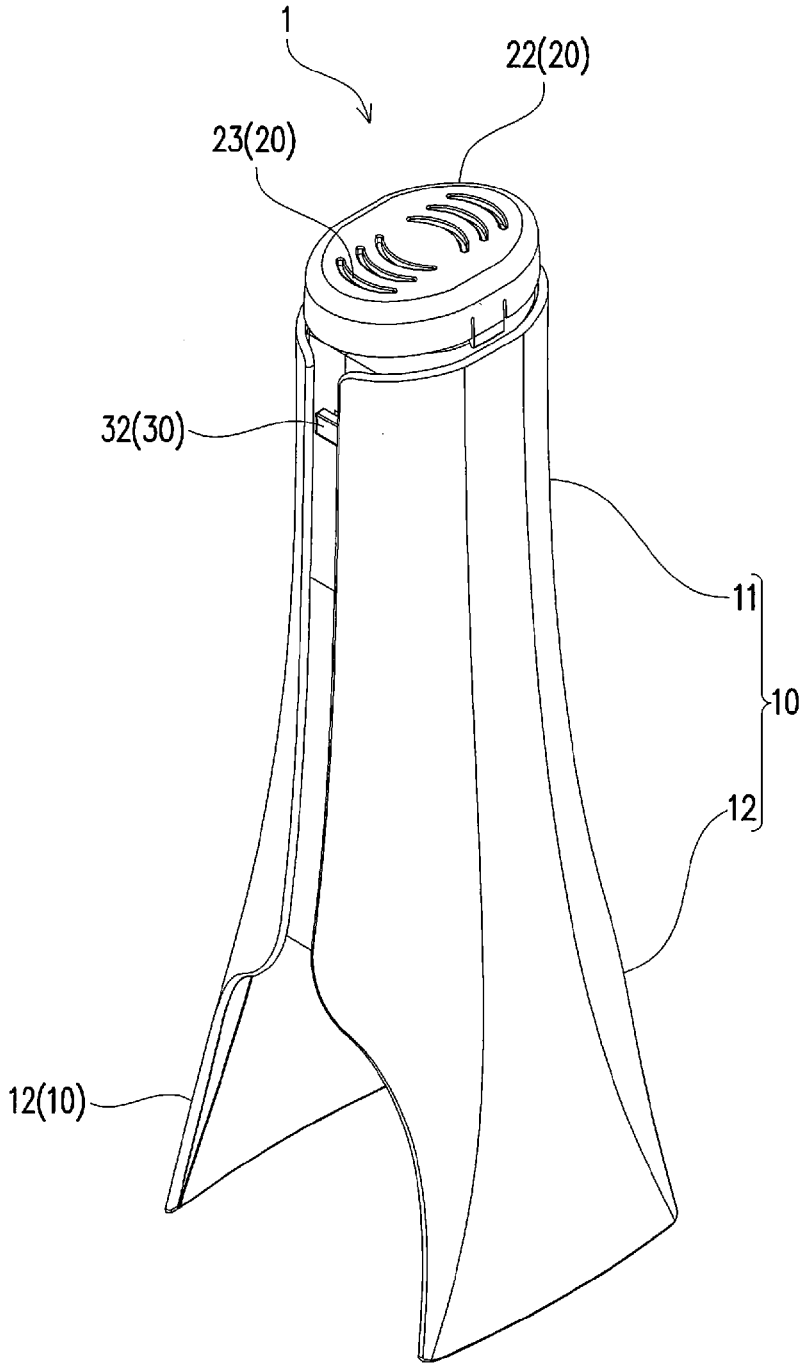
FIG. 1 is a schematic perspective view showing a boot housing device according to an embodiment of the present invention when a shoe receiving part is moved to the lowest position.

A boot housing device 1 according to this embodiment includes: a body 10 having an upper end and a lower end, the body 10 including two leg parts 12 arranged with a specific gap therebetween on its lower end side so as to allow a toe of a boot to be arranged in the gap; and an elevating member 20 including a support pole 21 supported by the body 10 and a shoe receiving part 22 that is attached to an upper end of the support pole 21 and is arranged above the body 10, the elevating member 20 being provided movably in an axial direction of the support pole 21.

According to such a configuration, when the boot housing device 1 houses boots, the elevating member 20 is moved in the axial direction of the support pole 21, corresponding to the length of the boot shaft. Thus, the shoe receiving part 22 is moved in the axial direction of the support pole 21 above the body 10 so as to be arranged at a position corresponding to the length of the boot shaft. After the shoe receiving part 22 is arranged at a position corresponding to the length of the boot shaft, the support pole 21 is inserted into the boot shaft of a boot for one foot. The shoe receiving part 22 abuts the insole of the boot for one foot, thereby supporting the boot for one foot. A boot for the other foot is housed in the boot housing device 1, with its toe being arranged between the two leg parts 12. In this way, a pair of boots are placed vertically, and thus the space can be saved. Since the shoe receiving part 22 can be positioned corresponding to the position of the boot shaft only by moving the elevating member 20 in the axial direction of the support pole 21, there is no need to store a plurality of parts.

On the other hand, after the pair of boots are detached from the boot housing device 1, the shoe receiving part 22 can be made close to the body 10 by moving the support pole 21. Thus, the space for the boot housing device 1 is saved also after the boots are detached.

The boot housing device 1 according to this embodiment may further include a positioning mechanism 30 configured to regulate the elevation of the elevating member 20 relative to the body.

According to such a configuration, the positioning mechanism 30 regulates the elevation of the elevating member 20, and therefore the position of the shoe receiving part 22 that has been determined corresponding to the position of the boot shaft is maintained. Thus, the shoe receiving part 22 can support the boot at a position determined by the movement of the elevating member 20. After the boot is detached, the positioning mechanism 30 can maintain the shoe receiving part 22 close to the body 10.

According to another aspect, the boot housing device 1 according to this embodiment may have a configuration in which the positioning mechanism 30 includes an engaging part 31 that is provided in the support pole 21 and is arranged along the axial direction of the support pole 21, and an engaging claw 32 that is provided in the body 10 and is movable in a direction intersecting the axial direction of the support pole 21.

According to such a configuration, the engaging claw 32 moves in a direction away from the engaging part 31 of the support pole 21, so that the engaging claw 32 is released from the engagement with the engaging part 31. This allows the support pole 21 to move along the axial direction. On the other hand, the engaging claw 32 moves in a direction close to the engaging part 31 so as to engage the engaging part 31, thereby regulating the movement along the axial direction of the support pole 21. Thus, the positioning mechanism 30 enables the movement of the shoe receiving part 22 and can maintain the position of the shoe receiving part 22 determined relative to the body 10.

According to another aspect, the boot housing device 1 according to this embodiment may have a configuration in which the shoe receiving part 22 includes a housing part 23 capable of housing a drug.

According to such a configuration, a drug is housed in the housing part 23, and therefore the drug is present in the vicinity of the insole of the boot when the shoe receiving part 22 supports the boot. This allows effects of the drug to be exerted inside the boot.

As described above, the boot housing device 1 according to this embodiment exerts an excellent effect of eliminating the need to store a plurality of parts.

Hereinafter, an embodiment of the boot housing device according to the present invention is described with reference to FIG. 1 to FIG. 3.

Figure 2:
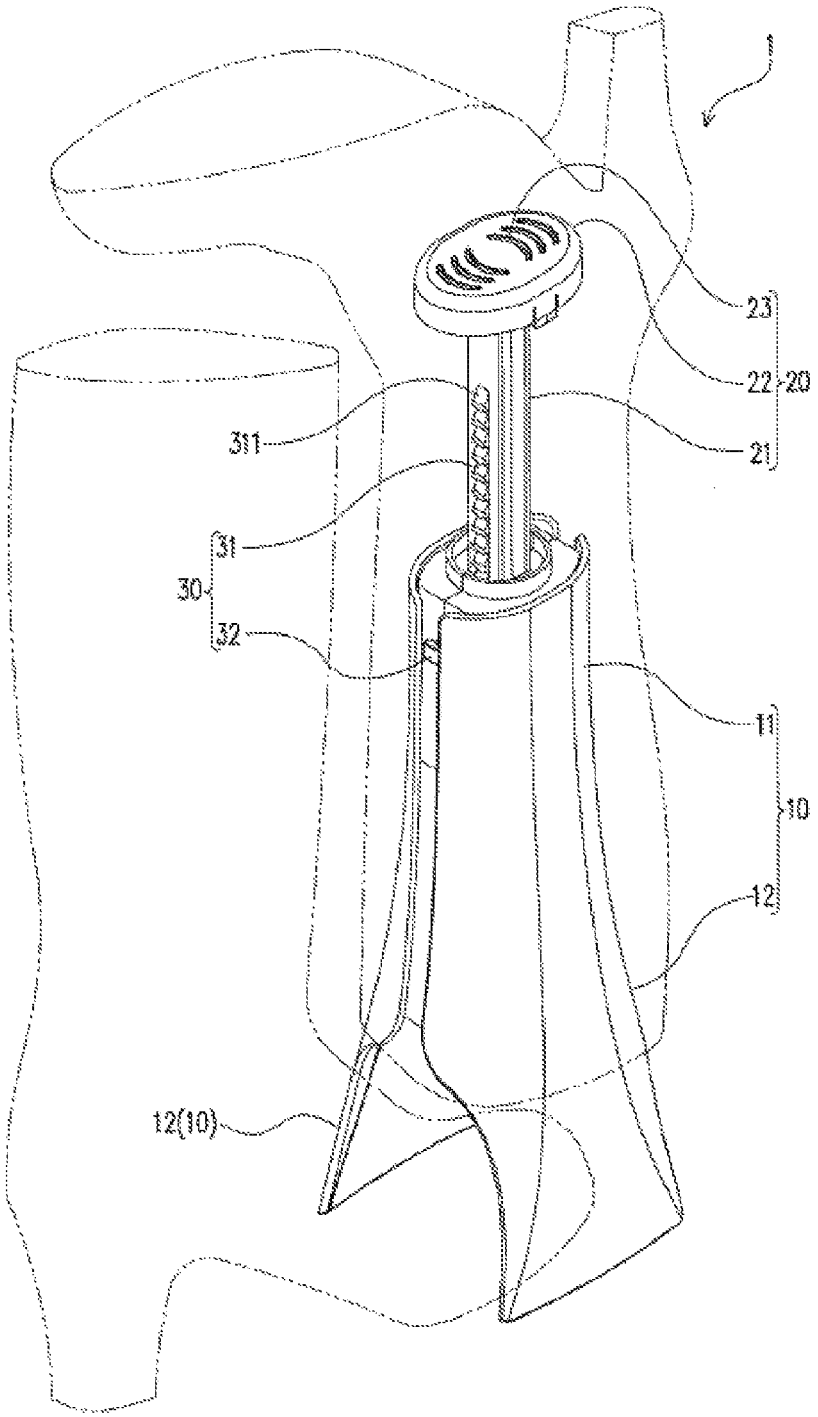
FIG. 2 is a schematic perspective view showing the boot housing device according to the aforementioned embodiment when the shoe receiving part is moved upwardly.

As shown in FIG. 1 and FIG. 2, a boot housing device 1 according to this embodiment includes: a body 10 having an upper end and a lower end, the body 10 including two leg parts 12 arranged with a specific gap therebetween on its lower end side so as to allow a toe of a boot to be arranged in the gap; and an elevating member 20 including a support pole 21 supported by the body 10 and a shoe receiving part 22 that is attached to an upper end of the support pole 21 and is arranged above the body 10, the elevating member 20 being provided movably in an axial direction of the support pole 21. The boot housing device 1 according to this embodiment further includes a positioning mechanism 30 that regulates the elevation of the elevating member 20 relative to the body 10.

The body 10 includes a torso part 11 elongated in one direction (in the up-down direction). The torso part 11 is configured to have a length capable of housing the support pole 21. The torso part 11 is configured so as to have an upper end capable of abutting the lower end of the shoe receiving part 22 when the support pole 21 is housed therein. In this embodiment, the torso part 11 has an elliptical cross section with its diameter gradually increasing from the upper end toward the lower end.

The two leg parts 12 are each coupled to the lower end of the torso part 11. In this embodiment, the two leg parts 12 are arranged in the minor axis direction of the cross section of the torso part 11, and are configured to allow the tip of the boot to be inserted therebetween in the major axis direction. The two leg parts 12 each have an outer surface (curved surface) that is continuous with the outer circumferential surface of the torso part 11. That is, the two leg parts 12 are each in the form of a curved plate. In this embodiment, the two leg parts 12 are each enlarged downward. Thus, the lower end surfaces of the two leg parts 12 form an installation surface that allows a stable installation.

The support pole 21 is guided by a guide member (not numbered) provided in the torso part 11 so as to be movable in the axial direction. The support pole 21 moves in the axial direction, thereby causing the shoe receiving part 22 to move in a direction toward or away from the upper end of the torso part 11.

The shoe receiving part 22 is formed into an elliptical shape in front view, and is fixed to the upper end (tip) of the support pole 21. The shoe receiving part 22 is fixed to the support pole 21 with its major axis and minor axis coinciding with the major axis and minor axis of the torso part 11. When the support pole 21 is housed in the torso part 11, the shoe receiving part 22 can abut the upper end of the torso part 11 so as to coincide with the shape of the upper end of the torso part 11. The shoe receiving part 22 includes the housing part 23 capable of housing a drug.

The housing part 23 is formed by hollowing the shoe receiving part 22. The housing part 23 is exposed by opening the upper surface of the shoe receiving part 22, and is closed by closing the upper surface of the shoe receiving part 22 after the drug is housed therein. The housing part 23 allows the efficacy influence of the drug to be exerted in the boot by having pores (not numbered) on the upper surface of the shoe receiving part 22. Examples of the drug include a dehumidifying material and a deodorizer.

The positioning mechanism 30 includes the engaging part 31 arranged along the axial direction of the support pole 21, and the engaging claw 32 that is provided in the body 10 and is movable in a direction intersecting the axial direction of the support pole 21.

The engaging part 31, for example, is composed of a plurality of projections 311 projecting from the surface of the support pole 21. The plurality of projections 311 are provided in alignment along the axial direction of the support pole 21. The engaging part 31 is arranged at a position that can be opposed to the engaging claw 32. The plurality of projections 311 are arranged at an interval so as to allow the engaging claw 32 to be fitted thereinto.

Figure 3:
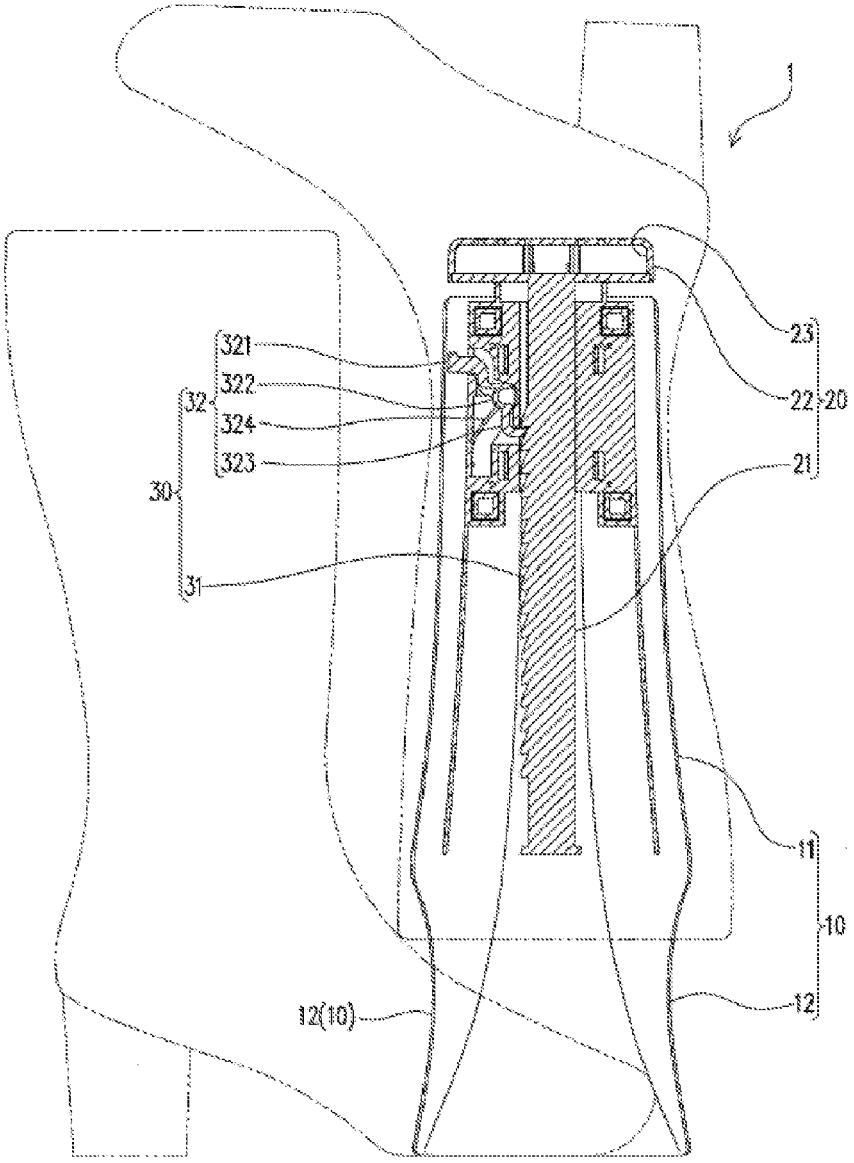
FIG. 3 is a schematic sectional view showing the boot housing device according to the aforementioned embodiment.

As shown in FIG. 3, the engaging claw 32 is rotatably supported by the torso part 11. The engaging claw 32 includes an operation button 321 for moving the engaging claw 32, a rotational support part 322 that is pivotally supported by the body 10 and is provided continuously with the operation button 321, and a claw part 323 that is provided continuously with the rotational support part 322 and is rotatable about the rotational support part 322 serving as a rotation fulcrum. The positioning mechanism 30 in a normal state includes an elastic body 324 biasing the engaging claw 32 (claw part 323) toward the space between the projections 311. In this embodiment, the elastic body 324 is in the form of a leaf spring. More specifically, the elastic body 324 is in the form of a strip, and extends from the rotational support part 322 with its tip being in contact with the torso part 11. Thus, the elastic body 324 biases the engaging claw 32, and acts to push the claw part 323 into the space between the projections 311. It should be noted that the operation button 321, the rotational support part 322, the claw part 323, and the elastic body 324 are resin molded articles which are integrally molded, in this embodiment.

In the positioning mechanism 30 according to this embodiment in a normal state, the claw part 323 of the engaging claw 32 is pushed into the space between the projections 311 due to the bias applied by the elastic body 324, so that the claw part 323 is engaged with the projections 311 (the movement of the support pole 21 is regulated), as shown in FIG. 1 to FIG. 3. The operation button 321 is operated to be pressed, thereby causing the engaging claw 32 to entirely rotate about the rotational support part 322 serving as a rotation fulcrum, so that the claw part 323 is retracted from the space between the projections 311 (the movement of the support pole 21 is permitted).

The configuration of the boot housing device 1 according to this embodiment is as described above. Next, the action of the boot housing device 1 according to this embodiment is described.

First, the operation button 321 is operated to be pressed, thereby causing the rotational support part 322 to turn around, so that the claw part 323 is released from the state of being fitted into the space between the plurality of projections 311. Thus, the support pole 21 is released from the state of being fixed to the torso part 11, so as to be movable in the axial direction.

The support pole 21 is withdrawn from the position of being housed in the torso part 11 by the shoe receiving part 22 being gripped and withdrawn upwardly. The shoe receiving part 22 moves away from the upper end of the torso part 11 as the support pole 21 is withdrawn. The shoe receiving part 22 moves away from the upper end of the torso part 11, corresponding to the length of the boot shaft of the boot to be housed, thereby allowing the position of the shoe receiving part 22 to be determined. The operation button 321 is released from being pressed upward in the state where the position of the shoe receiving part 22 is determined, thereby causing the rotational support part 322 to turn around due to the elastic force of the elastic body 324, so that the claw part 323 is fitted into the space between the adjacent projections 311. Thus, the support pole 21 is again fixed to the torso part 11, and the shoe receiving part 22 is fixed to the determined position.

A boot for one foot is housed in the boot housing device 1 by insertion of the shoe receiving part 22 located at the determined position into the boot shaft. Thereafter, a boot for the other foot is housed in the boot housing device 1 by insertion of the toe into the space between the two leg parts 12. In this way, a pair of boots are housed in a vertical arrangement using the boot housing device 1.

On the other hand, when the boot thus housed is detached from the boot housing device 1, and only the boot housing device 1 is stored, the operation button 321 is operated to be pressed, thereby causing the rotational support part 322 to turn around, so that the claw part 323 is released from the state of being fitted into the space between the adjacent projections 311. Thus, the support pole 21 is released from the state of being fixed to the torso part 11, so as to be movable in the axial direction.

The support pole 21 is housed in the torso part 11 by the shoe receiving part 22 being gripped and pushed downward. Then, the shoe receiving part 22 is pushed down until its lower end abuts the upper end of the torso part 11, so that the boot housing device 1 can be stored without occupying a large space.

As described above, the boot housing device 1 according to this embodiment includes: a body 10 having an upper end and a lower end, the body 10 including two leg parts 12 arranged with a specific gap therebetween on its lower end so as to allow a toe of a boot to be arranged in the gap; and an elevating member 20 including a support pole 21 supported by the body 10 and a shoe receiving part 22 attached to the upper end of the support pole 21 and arranged above the body 10, the elevating member 20 being provided movably in an axial direction of the support pole 21.

According to such a configuration, when the boot housing device 1 houses boots, the elevating member 20 is moved in the axial direction of the support pole 21, corresponding to the length of the boot shaft. Thus, the shoe receiving part 22 is moved in the axial direction of the support pole 21 above the body 10 so as to be arranged at a position corresponding to the length of the boot shaft. After the shoe receiving part 22 is arranged at a position corresponding to the length of the boot shaft, the support pole 21 is inserted into the boot shaft of a boot for one foot. The boot for one foot is supported by the shoe receiving part 22 abutting the insole of the boot for one foot. A boot for the other foot is housed in the boot housing device 1, with its toe being arranged between the two leg parts 12. Thus, the space is saved since the boots are placed vertically. Since the shoe receiving part 22 can be positioned corresponding to the position of the boot shaft only by moving the elevating member 20 in the axial direction of the support pole 21, there is no need to store a plurality of parts. On the other hand, after the pair of boots are detached from the boot housing device 1, the shoe receiving part 22 can be moved close to the body 10 by moving the support pole 21. Thus, the space for the boot housing device 1 is saved also after the boots are detached.

The boot housing device 1 according to this embodiment further includes the positioning mechanism 30 configured to regulate the elevation of the elevating member 20 relative to the body 10.

According to such a configuration, the positioning mechanism 30 regulates the elevation of the elevating member, and therefore the position of the shoe receiving part 22 that has been determined corresponding to the position of the boot shaft is maintained. Thus, the shoe receiving part 22 can support the boot at a position determined by the movement of the elevating member 20. After the boot is detached, the positioning mechanism 30 can maintain the shoe receiving part 22 close to the body 10.

According to another aspect of the boot housing device 1 of this embodiment, the positioning mechanism 30 includes an engaging part 31 that is provided in the support pole 21 and is arranged along the axial direction of the support pole 21, and an engaging claw 32 that is provided in the body 10 and is movable in a direction intersecting the axial direction of the support pole 21.

According to such a configuration, the engaging claw 32 moves in a direction away from the engaging part 31 of the support pole 21, so that the engaging claw 32 is released from the engagement with the engaging part 31.

This allows the support pole 21 to move along the axial direction. On the other hand, the engaging claw 32 moves in a direction close to the engaging part 31 so as to engage the engaging part 31, thereby regulating the movement along the axial direction of the support pole 21. Thus, the positioning mechanism 30 enables the movement of the shoe receiving part 22 and can maintain the determined position of the shoe receiving part 22.

According to another aspect of the boot housing device 1 of this embodiment, the shoe receiving part 22 includes a housing part 23 capable of housing a drug.

According to such a configuration, a drug is housed in the housing part 23, and therefore the drug is present in the vicinity of the insole of the boot when the shoe receiving part 22 houses the boot. This allows effects of the drug to be exerted inside the boot.

It should be noted that the boot housing device according to the present invention is not limited to the above described embodiments, and it is a matter of course that various modifications can be made without departing from the gist of the present invention. Further, it is also a matter of course that configurations and methods according to various modifications described below may be arbitrarily selected to be employed as the configurations and methods according to the aforementioned embodiments.

Figure 4:
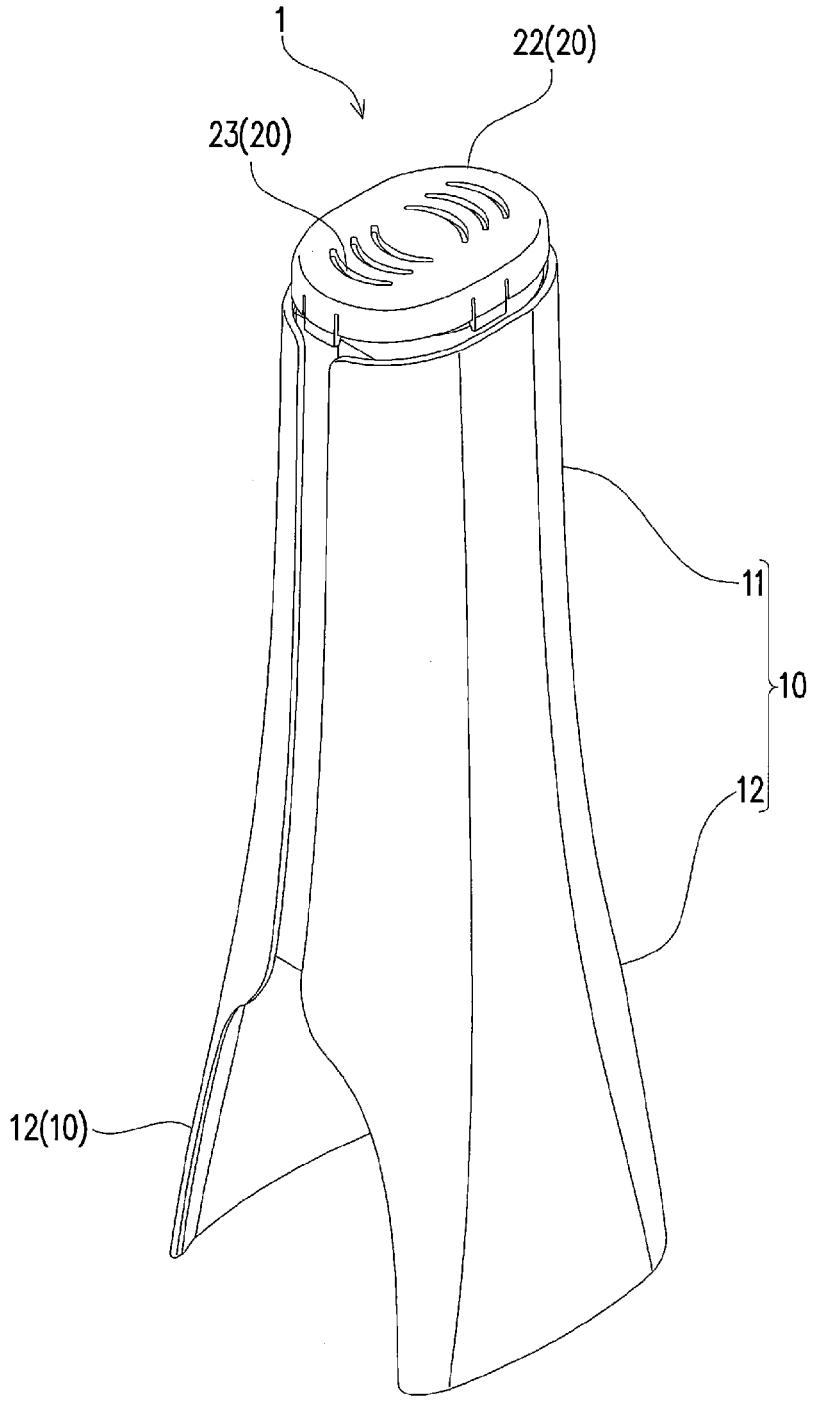
FIG. 4 is a schematic perspective view showing a boot housing device according to another embodiment of the present invention when a shoe receiving part is moved to the lowest position.
Figure 5:
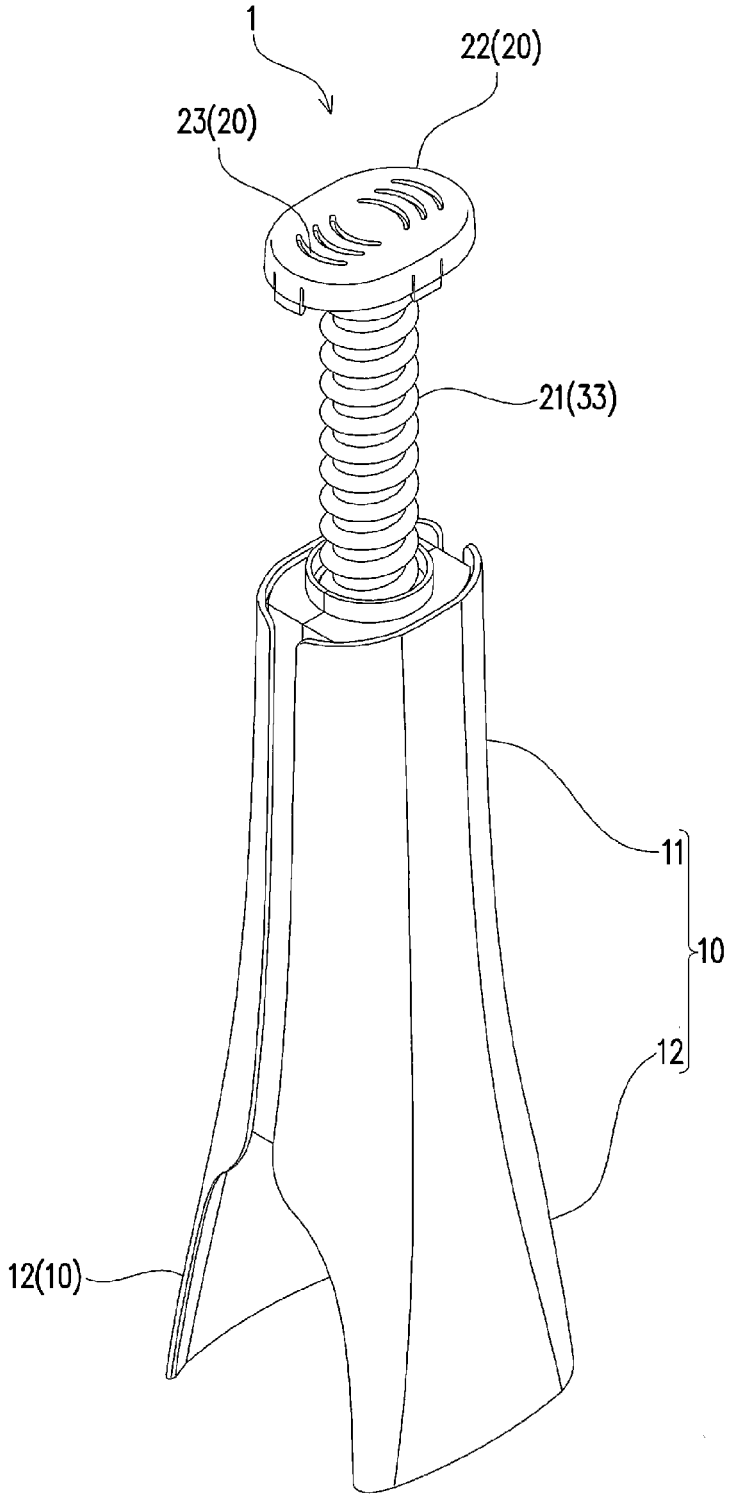
FIG. 5 is a schematic perspective view showing the boot housing device according to the other embodiment when the shoe receiving part is moved upwardly.

For example, the positioning mechanism 30 of the boot housing device 1 according to the above described embodiments is not limited to the positioning mechanism 30 including the engaging part 31 and the engaging claw 32. For example, the positioning mechanism 30 may be composed of an external thread 33 provided on the outer circumference of the support pole 21 and an internal thread (not shown) that is provided in the longitudinal direction of the torso part 11 and is threadedly engaged with the external thread 33, as shown in FIG. 4 and FIG. 5. The external thread 33 turns around, thereby allowing the shoe receiving part 22 to move away from the upper end of the torso part 11, corresponding to the length of the boot shaft, and to be maintained at the determined position. Specifically, the shoe receiving part 22 is gripped, and the support pole 21 is rotated about its axis relative to the torso part 11, thereby changing the length of the support pole 21 exposed from the torso part 11. This enables the shoe receiving part 22 to move toward and away from the upper end of the torso part 11. By the shoe receiving part 22 being located at the position determined corresponding to the length of the boot shaft, the boot housing device 1 can house a pair of boots.

Further, the positioning mechanism 30 of the boot housing device 1 according to the above described embodiments is not limited to the positioning mechanism 30 including the engaging part 31 and the engaging claw 32. For example, the positioning mechanism 30 may be composed of internal threads passing through from the outer circumference of the torso part 11 to the support pole 21 and an external thread that can abut the surface of the support pole 21 by being screwed from the outer circumference of the torso part 11 into the internal thread. The external thread is loosened by being rotated, so that the external thread moves away from the surface of the support pole 21, thereby allowing the fixation of the torso part 11 and the support pole 21 to be released. This allows the support pole 21 to be movable in the axial direction. The shoe receiving part 22 is moved to the determined position, and the external thread is tightened, thereby fixing the torso part 11 and the support pole 21. Thus, the boot housing device 1 can house one of the boots on the shoe receiving part 22.

Further, in the boot housing device 1 according to the above described embodiments, the support pole 21 is housed in the torso part 11. However, there is no limitation to this. The support pole 21 may be attached to the outer circumference of the torso part 11.

Further, in the boot housing device 1 according to the above described embodiments, the engaging part 31 is described as a plurality of projections 311 projecting from the surface of the support pole 21. However, there is no limitation to this. The engaging part 31 may be a plurality of grooves provided in the support pole 21 in alignment along the axial direction of the support pole 21, each of which is recessed from the surface of the support pole 21.

Further, in the boot housing device 1 according to the above described embodiments, the support pole 21 and the shoe receiving part 22 are described as separate parts. However, there is no limitation to this. The support pole 21 and the shoe receiving part 22 may be integrally formed. For example, the elevating member 20 may be composed of the support pole 21 having the function of the shoe receiving part 22.

Further, in the boot housing device 1 according to the above described embodiments, it is a matter of course that the boots include rain boots.

The boot housing device of this embodiment is as described above. However, the present invention is not limited to the above described embodiments, and the design can be appropriately modified within the scope intended by the present invention. The operational advantage of the present invention is also not limited to the foregoing embodiments. That is, the embodiments disclosed herein should be construed in all respects as illustrative but not limiting. The scope of the present invention is not indicated by the foregoing description but by the scope of the claims. Further, the scope of the present invention is intended to include all the modifications equivalent in the sense and the scope of the claims.

What is claimed is:

1. A boot housing device comprising:

a body: and an elevating member, wherein the body includes a torso part having an upper end and a lower end, and two leg parts arranged with a gap therebetween on a side close to the lower end of the torso part, the torso part has an elliptical cross section with its diameter gradually increasing from the upper end toward the lower end, the two leg parts are arranged with a gap therebetween in a minor axis direction of the cross section of the torso part, the elevating member includes a support pole supported by the torso part and configured to being inserted into a boot shaft of a boot and a shoe receiving part that is attached to an upper end of the support pole and is arranged above the body and is configured so that the boot is supported by the shoe receiving part adapted to abut an insole of the boot with the support pole inserted therein, wherein the elevating member is movable in an axial direction of the support pole relative to the body so as to allow the shoe receiving part to move toward and away from the upper end of the torso part.

2. The boot housing device according to claim further comprising:

as positioning mechanism configured to regulate elevation of the elevating member relative to the body.

3. The boot housing device according to claim 2, wherein the positioning mechanism includes an engaging part that is provided in the support pole and is arranged along the axial direction of the support pole, and an engaging claw that is provided in the body and is movable in a direction intersecting the axial direction of the support pole.

4. The boot housing device according to claim 3, wherein the shoe receiving part includes a housing part having a hollow structure.

5. The boot housing device according to claim 2, wherein the shoe receiving part includes a housing part having a hollow structure.

6. The boot housing, device according to claim 1. wherein the shoe receiving pan includes a housing part having hollow structure.

* * * * *